US009516942B2

(12) United States Patent
Merey

(10) Patent No.: US 9,516,942 B2
(45) **Date of Patent: *Dec. 13, 2016**

(54) FOLDABLE TABLE HAVING LEGS OF UNEQUAL LENGTH

(71) Applicant: Thomas G. B. Merey, Ontario (CA)

(72) Inventor: Thomas G. B. Merey, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/091,991

(22) Filed: Apr. 6, 2016

(65) Prior Publication Data

US 2016/0220015 A1 Aug. 4, 2016

Related U.S. Application Data

(62) Division of application No. 14/673,893, filed on Mar. 31, 2015, now Pat. No. 9,332,834.

(30) Foreign Application Priority Data

Apr. 1, 2014 (CA) ..... 2848519

(51) Int. Cl.

| | |
|---|---|
| ***A47B 3/00*** | (2006.01) |
| ***A47B 3/091*** | (2006.01) |
| ***A47B 3/08*** | (2006.01) |
| ***A47B 13/02*** | (2006.01) |
| *A47B 21/06* | (2006.01) |

(52) U.S. Cl.

CPC ..... *A47B 3/091* (2013.01); *A47B 3/0818* (2013.01); *A47B 3/0918* (2013.01); *A47B 13/02* (2013.01); *A47B 2021/066* (2013.01)

(58) Field of Classification Search

CPC ..... A47B 3/00; A47B 3/002; A47B 3/02; A47B 3/08; A47B 3/091; A47B 13/02; A47B 37/00; A47B 21/02; A47B 2003/02; A47B 2003/025; A47B 2009/006

USPC ..... 108/115, 118, 121, 122, 124, 125

See application file for complete search history.

(56) References Cited

U.S. PATENT DOCUMENTS

| | | | | |
|---|---|---|---|---|
| 5,390,999 | A * | 2/1995 | Fuller | A47B 83/008 297/377 |
| 6,314,892 | B1 * | 11/2001 | Favini | A47B 3/002 108/115 |
| 6,494,419 | B2 * | 12/2002 | Pai | A45D 19/04 108/132 |
| 2005/0150724 | A1 * | 7/2005 | Snider | B25H 1/04 182/129 |
| 2008/0092786 | A1 * | 4/2008 | Chen | A47B 3/08 108/131 |
| 2010/0186640 | A1 * | 7/2010 | Leng | A47B 3/02 108/119 |
| 2011/0155021 | A1 * | 6/2011 | Geitner | A47B 3/08 108/25 |

* cited by examiner

*Primary Examiner* — Daniel Rohrhoff
(74) *Attorney, Agent, or Firm* — Young & Thompson

(57) ABSTRACT

The foldable table has a flat Labe top and a pair of leg assemblies which fold inward from an operative position to an inoperative position. The leg assemblies are pivotal about separate axes which are spaced an unequal distance from the table top. When the leg assemblies are folded in an inoperative position, both of the leg assemblies lie parallel to each other and to the table top.

2 Claims, 11 Drawing Sheets

FOLDABLE TABLE HAVING LEGS OF UNEQUAL LENGTH

CROSS-REFERENCE TO RELATED PRIOR APPLICATION

This application is a division of application Ser. No. 14/673,893 filed on Mar. 31, 2015 which application claims priority pursuant to 35 USC 119 of Canadian application no. 2,848,519 filed Apr. 1, 2014 which application is herein incorporated by reference in its entirety.

FIELD OF THE INVENTION

This invention relates to folding tables and more particularly to a folding table having legs which fold together compactly in order to reduce the space occupied by the table when not in use.

BACKGROUND OF THE INVENTION

A folding table is conventionally composed of a table top and legs which are pivotally attached along its periphery. The table is folded by rotating or folding the legs inward until they are close to the underside of the table top. The table can then be stored in a space significantly smaller than the space occupied by the table when the leas are unfolded. However the folded legs still add significantly to the space occupied by the table. That is because the folded legs do not rest flat against the table top but are angled out from it. The more the legs, the greater the angle of the outermost lea from the underside of the table top. The angled legs add significantly to the space occupied by the table.

I have invented a folding table in which the legs when folded are either flat against the underside of the table top or parallel and very close to the underside. The space occupied by the legs is significantly less than the space of conventional folding table of the same size.

SUMMARY OF THE INVENTION

Briefly my foldable table comprises: a planar table top having parallel oppositely facing upper and lower surfaces and larger and smaller leg assemblies. The leg assemblies each have a floor-contacting surface and each is pivotal with respect to the table top from an operative position in which the leg assemblies are unfolded and support the table top in a position for se to an inoperative position in which the leg assemblies are folded flat against the table top. The larger and smaller leg assemblies are pivotal about separate axes. One axis is spaced apart from the underside of the table top a distance smaller than the space between the other axis and the underside The larger leg assembly, when the larger and smaller leg assemblies are in the inoperative position, lies adjacent to and between the underside of the table top and the smaller leg assembly.

DESCRIPTION OF THE DRAWINGS The folding table of the invention is described in detail with reference to the accompanying drawings in which:

FIG. 1*a* is an elevation le folding table from the rear;

FIG. 1*b* is an elevation of the folding table from one or its sides;

FIG. 1*c* is a plan view of the folding table;

FIG. 1*d* is a perspective view of the folding table from the front;

Figure 6D:
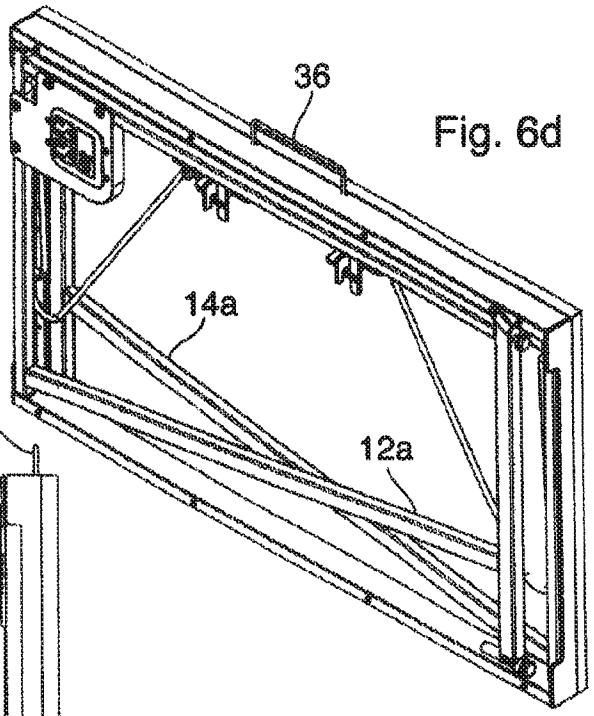
Figure 6C:
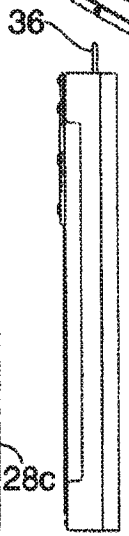
Figure 6A:
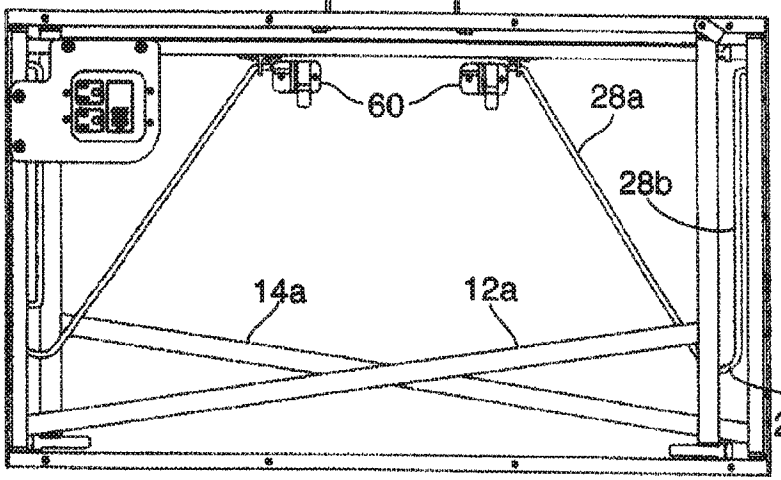
Figure 6B:
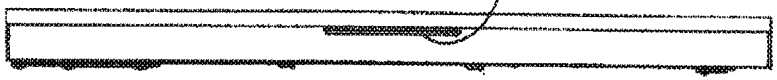
Figure 8:
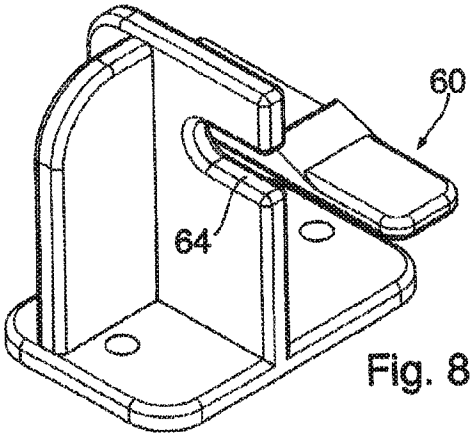
Figure 7:
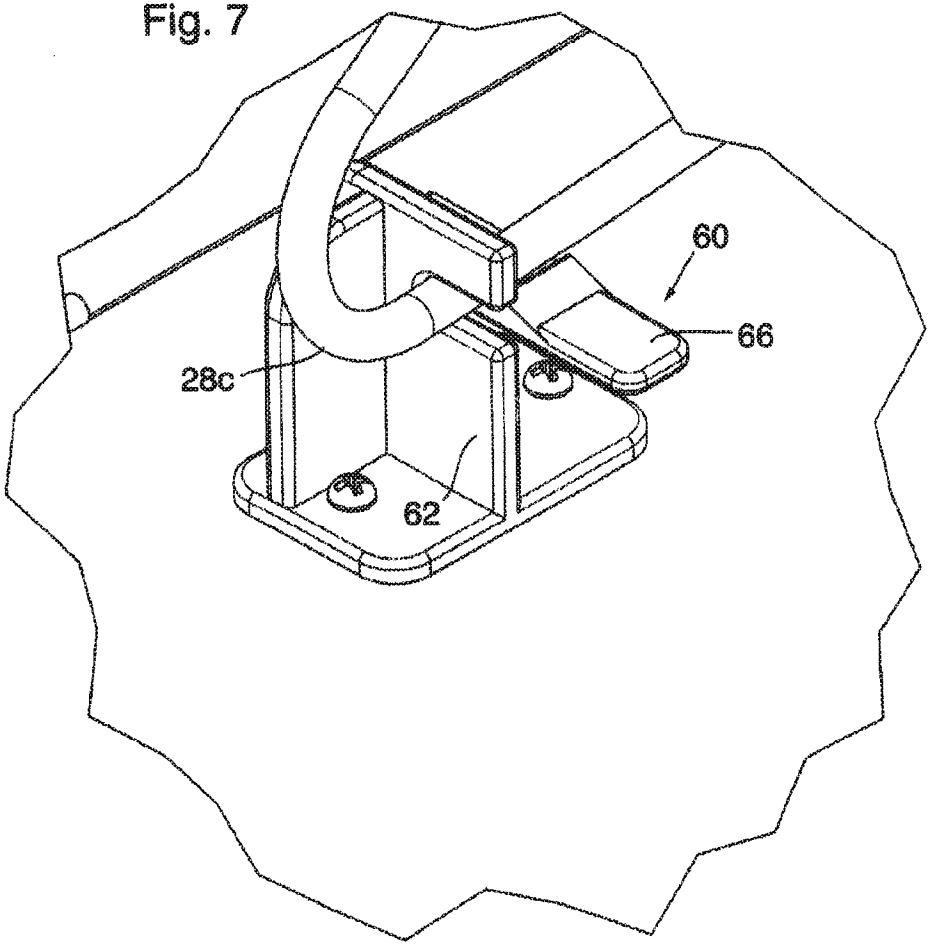

FIG. 6*a* is a view of the underside of the folding table in an inoperative position;

FIG. 6*b* is a side view of the rear wall of the folding table fully folded in an inoperative position;

FIG. 6*c* is a view of a side wall of the folding table fully folded in an inoperative position;

FIG. 6*d* is a perspective view of the underside of the folding table fully folded in an inoperative position;

FIG. 7 is an enlarged perspective view of a brace lock in combination with a portion of a brace; and FIG. 8 is a perspective view of the brace lock.

Figure 11:
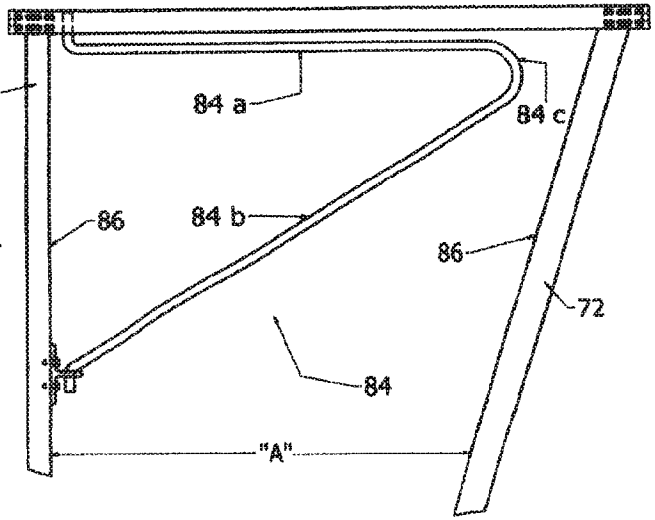
Figure 12:
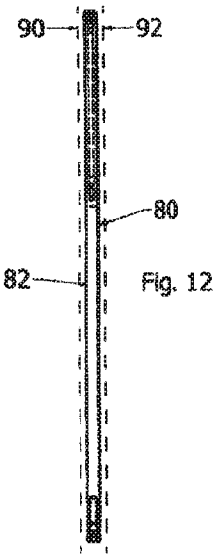
Figure 9:
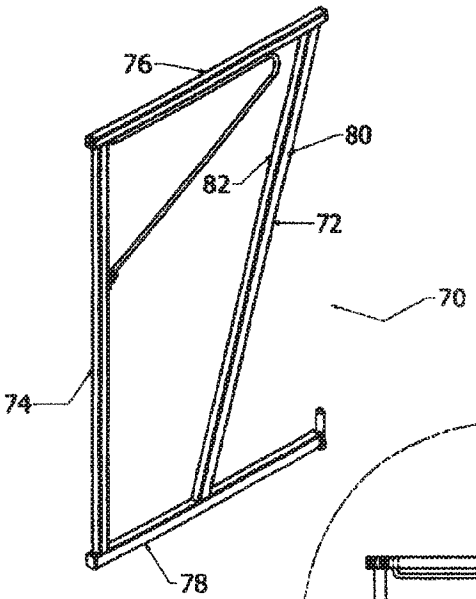
Figure 10:
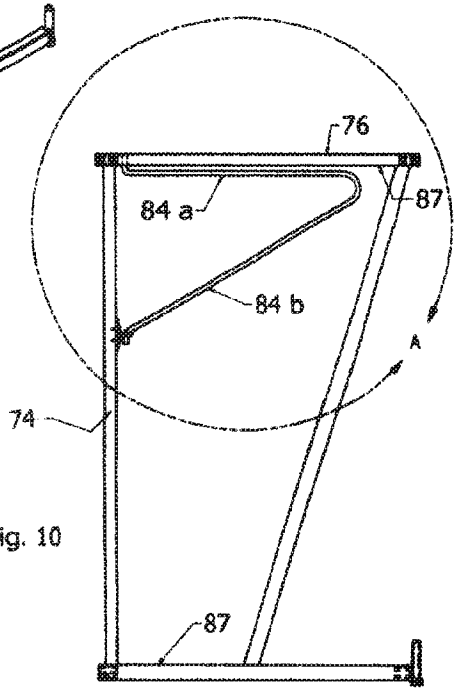
Figure 13A:
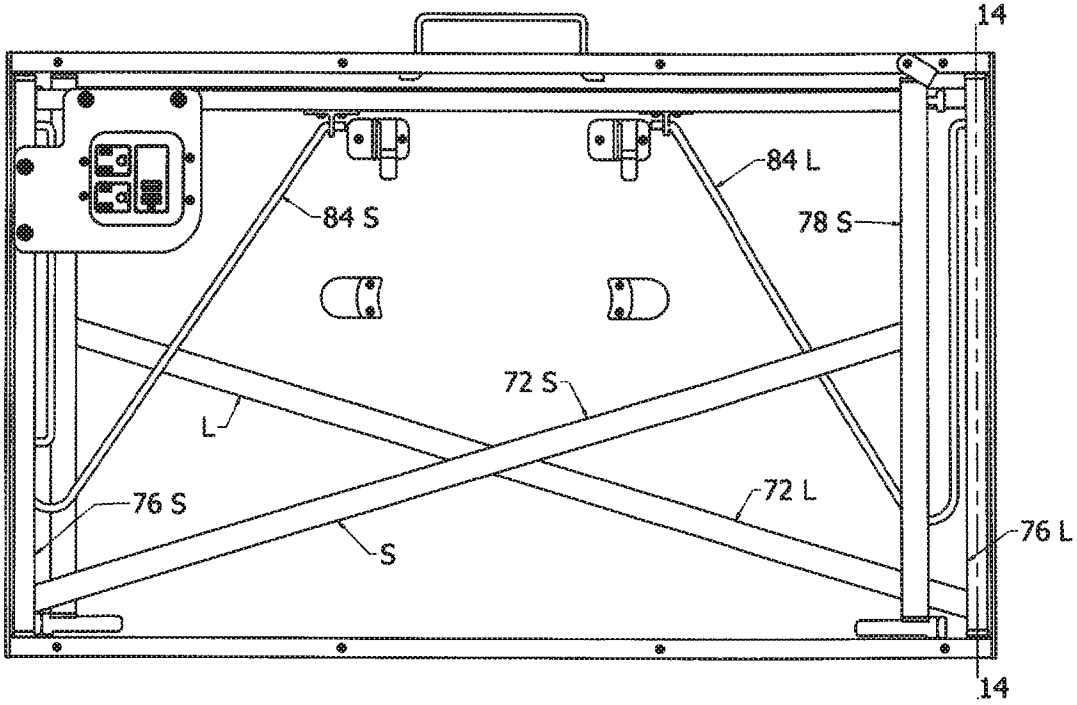
Figure 13B:
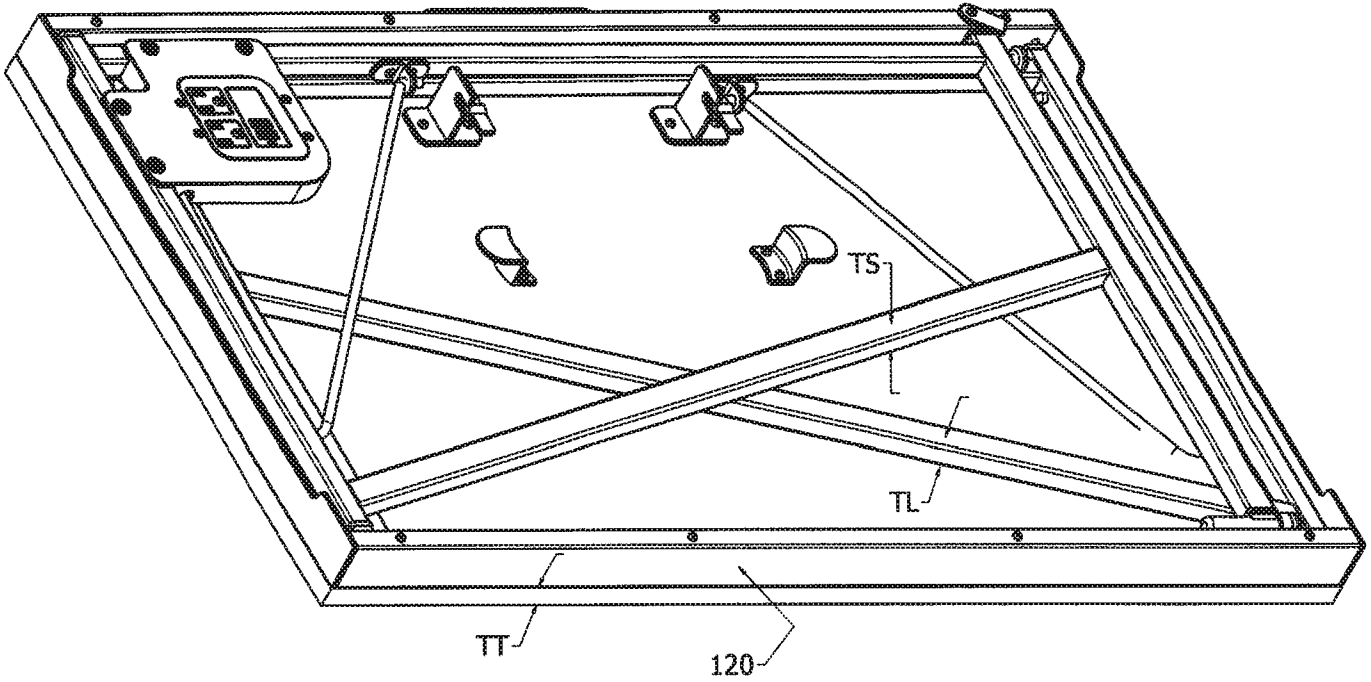

FIG. 9 is a perspective view of a leg assembly;

FIG. 10 is a side view of the leg assembly;

FIG. 11 is an enlarged view of the area of the leg assembly within the circle in FIG. 10;

FIG. 12 is a side view of the leg assembly;

FIG. 13*a* is a view of the underside of the folding table in an inoperative or folded state;

FIG. 13*b* is a perspective view of the underside of the folding table; and

Figure 14:
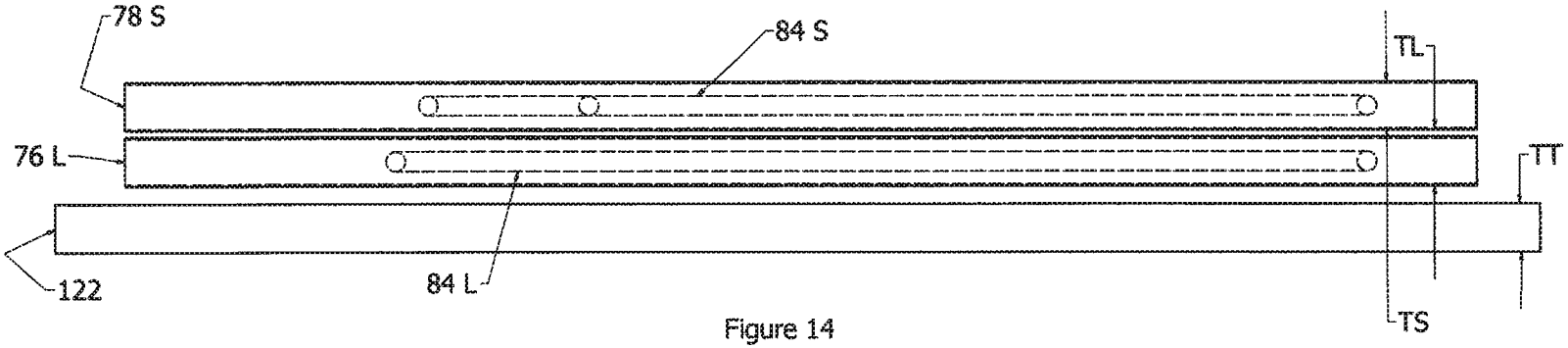

FIG. 14 is an enlarged view of a side view, partly in section on line 14-14 of FIG. 13*a* of the folding table in an inoperative state.

Like reference characters refer to like parts throughout the description of the drawings.

DESCRIPTION OF THE PREFERRED EMBODIMENTS

With reference to FIGS. 1*a* to 1*d*, the folding table, generally 10 has a planar table top having parallel oppositely facing upper and lower surfaces 10*a*, b, respectively. The table top is supported by a pair of leg assemblies, generally 12, 14 and the assemblies rest on feet 16 attached to threaded studs 18 to facilitate the adjustment of the height of the table top in the conventional mariner. Preferably, the leg assemblies are constructed of tubular steel for the sake of lightness of weight and economy of construction.

Figure 1D:
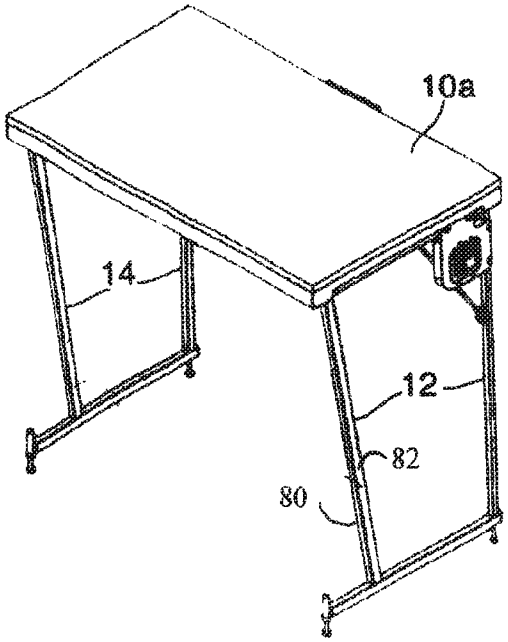
Figure 1B:
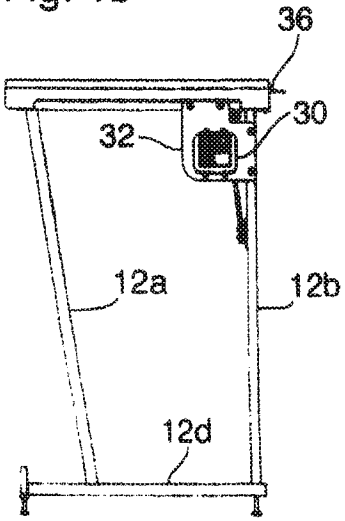
Figure 1A:
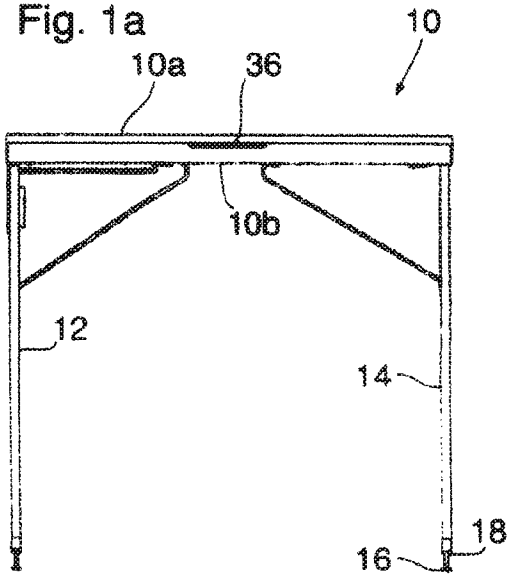
Figure 1C:
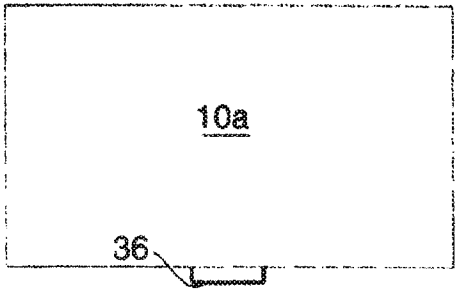
Figure 2:
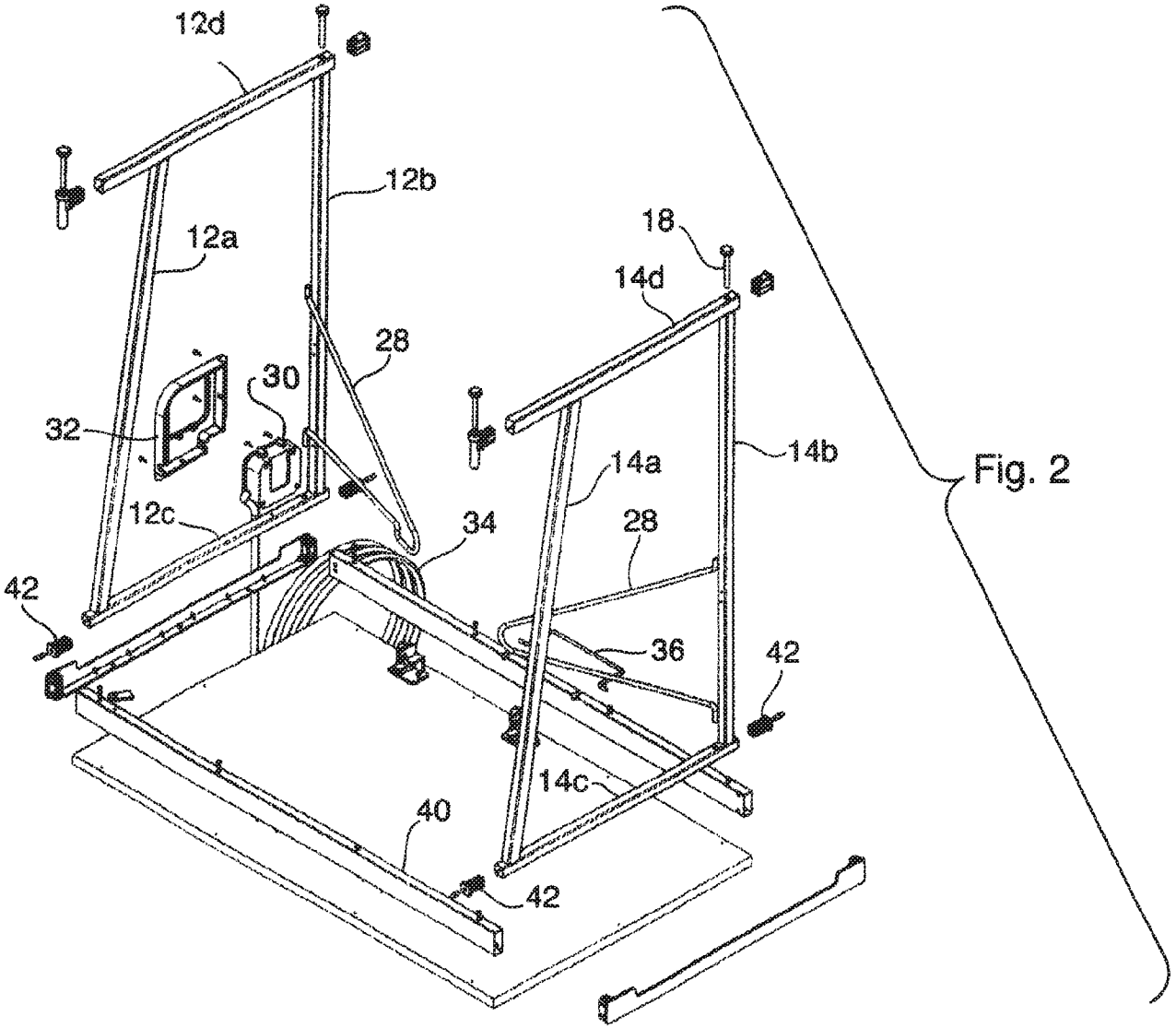
FIG. 2 is an exploded perspective view of the underside of the folding table.

With reference to FIGS. 1 and 2, the leg assemblies are provided with forward and rear legs 12*a,b* and 14*a,b* respectively which are interconnected at the top by upper webs 12*c*, 14*c* respectively, and at the bottom by lower webs 12*d*, 14*d*, respectively. The legs in each leg assembly accordingly fold as a unit.

Braces 28 are attached to the rear legs 12*b*, I 4*b* for selectively immobilizing the leg assemblies relative to the table top. The operation of the braces is described below.

Preferably the folding table is provided with an array 30 of one or more electrical outlets to receive the plug of a computer, a desk lamp and any other electrical appliance that might rest on the table top The array of outlets is contained in a housing 32. The outlets in the array are connected to a source of electrical power by means of an electrical wire 34. The table is also provided with a handle 36 for carrying the table when it is folded.

Figure 3:
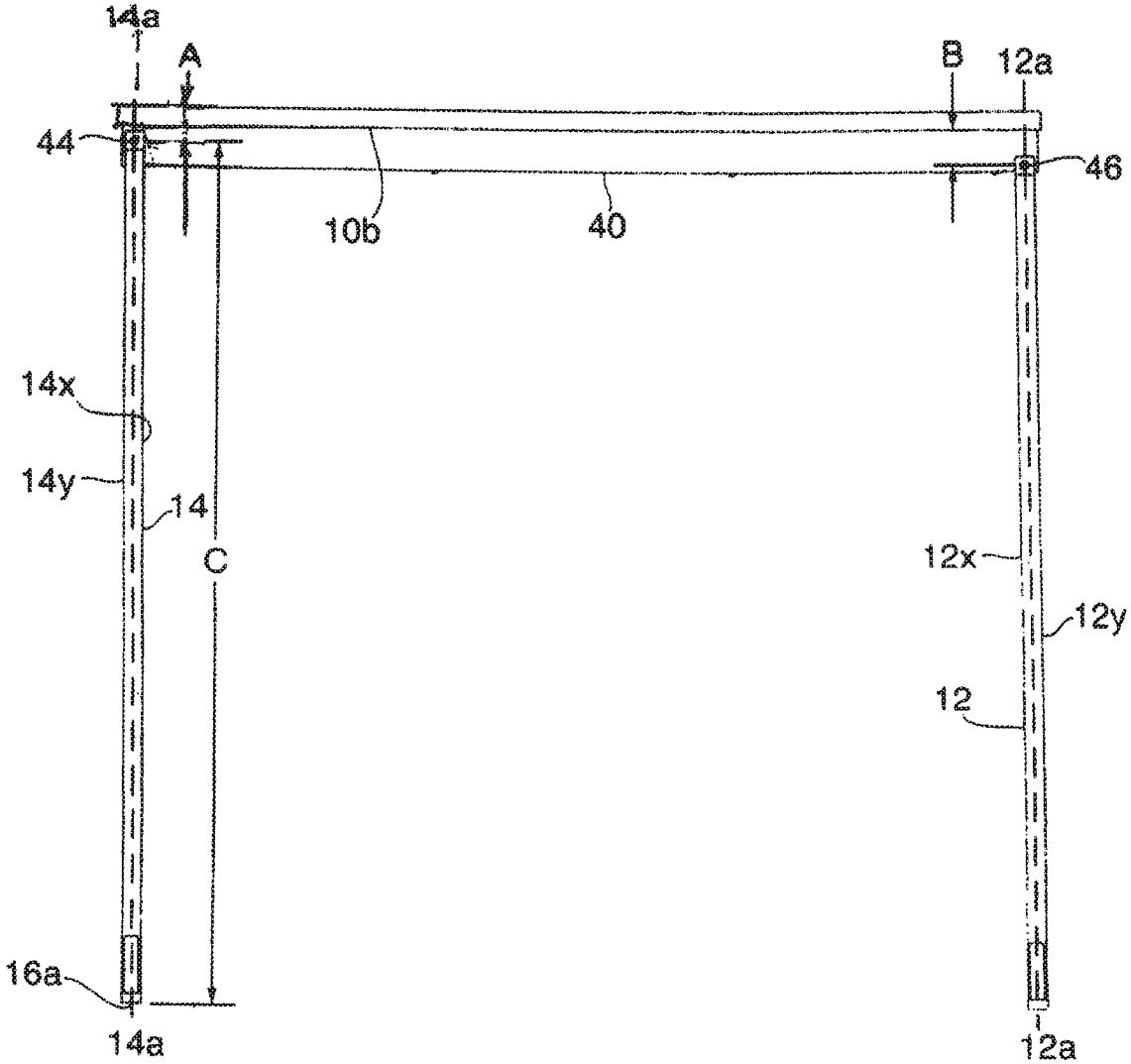
FIG. 3 is a simplified elevation in larger scale of the folding table in an operative position and in the absence of braces.

With reference to FIGS. 2 and 3, the leg assemblies are attached to a frame 40 beneath the table top. Attachment is by means of pivotal connections or swivels 42. Leg assembly 14 pivots about a first axis 44 relative to the table top while leg assembly 12 is pivots about a second axis 46 relative to the table top. The two axes are spaced an unequal distance from the table top. In FIG. 3, the distance "A" between the first axis 44 and the lower surface 10*b* of the table top, measured perpendicular to the table top is less than the distance "B" between the second axis 46 and the lower surface of the table top.

Since the distances between the two axes and the table top being different, the lengths of the two leg assembly are also different otherwise the table top would not be level when the table was unfolded. Axis 44 being closer to the table top, than axis 46, leg assembly 14 must be longer than assembly 12. The length of leg assembly 14 is marked C in FIG. 3 and is the vertical distance between axis 44 to which the leg is attached and the floor-contacting surface 16*a* of the leg when the subject folding table is unfolded for use. The length is measured on the longitudinal axis of each leg in the assembly. Accordingly the length of leg 14 in FIG. 3 is measured on the longitudinal axis 14*a*-14*a* and the length of leg assembly 12 is measured on its longitudinal axis 12*a*-42*a*.

Figure 4:
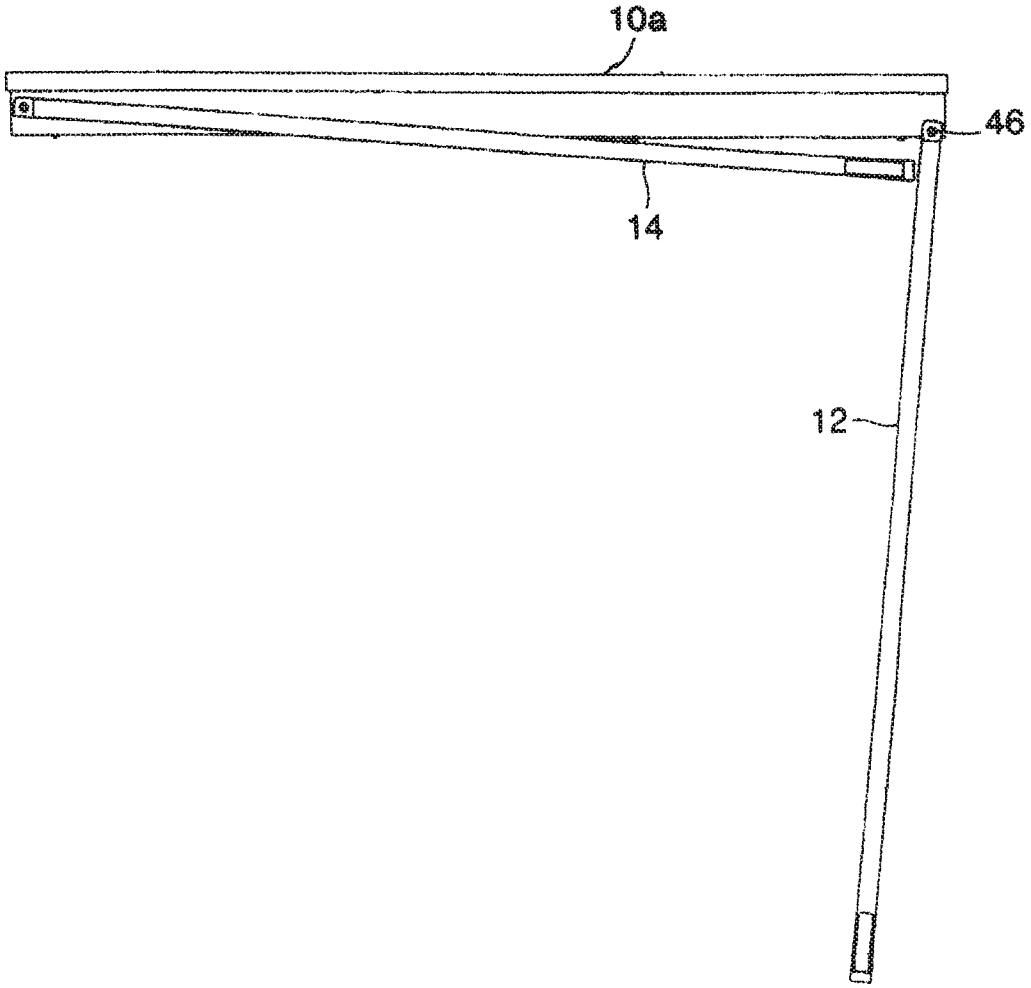
FIG. 4 is another simplified elevation of the folding table in the absence of braces as it is being folded into an inoperative position.
Figure 5:
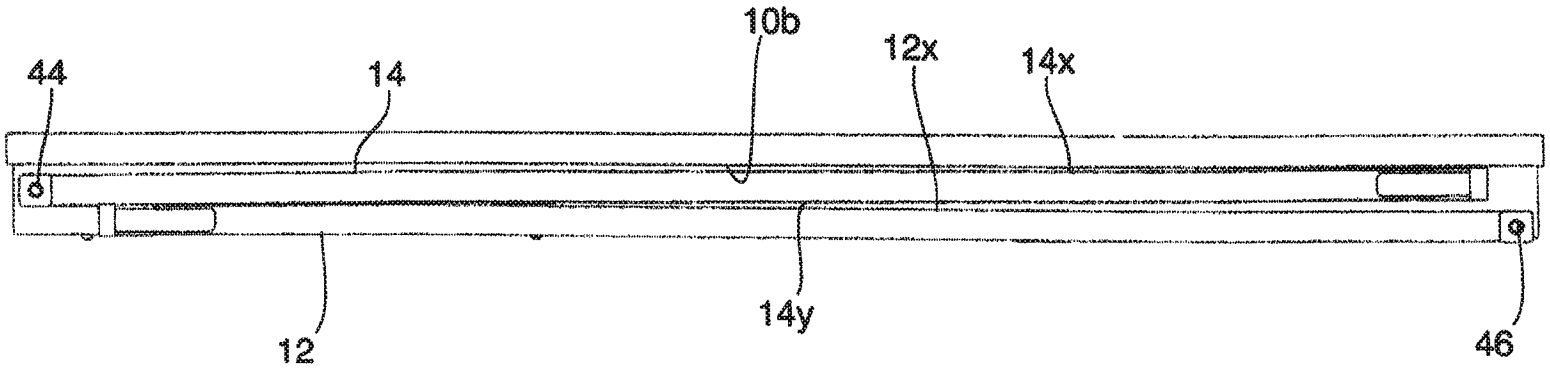
FIG. 5 is an elevation of the folding table in a fully folded or inoperative position.

With reference to FIGS. 4-6, as a result of the unequal spacing of the first and second axes from the lower and upper surfaces of the table top, the legs of the larger leg assembly 14, when folded inward to an inoperative position, fit into the space above the second axis 46. While in the space the legs of assembly 14 are adjacent to the lower surface 10*b* of the table top along its entire length, The legs of the shorter leg assembly 12 are adjacent to the legs of the longer leg assembly 14 along their entire lengths as illustrated in FIG. 5. The longitudinal axes of the longer and shorter leg assemblies are accordingly parallel to one another and to the upper and lower surfaces of the table top. The table top and the legs are side by side and no space is wasted between them. The result is that the folding table, when in an inoperative position, is compact and adapted to fit into confined spaces.

It will be observed from FIGS. 3 and 5 that the inwardly facing side edges 14*x* of the legs of the longer leg assembly when in a folded state lie adjacent to the lower surface I Ob of the table top throughout their lengths while the inwardly facing side edges 12*x* of the legs of the shorter leg assembly lie adjacent to the outwardly facing side edges 14*y* of the larger leg assembly throughout their lengths. In other words, the upper and lower surfaces lie in parallel planes and the longitudinal axes of the two leg assemblies are parallel to those planes when the leg assemblies are folded together in an inoperative state beneath the table top.

Unfolding of the leg assemblies involves first rotating the shorter leg assembly followed by rotating the longer assembly until they are both oriented at 90 degrees relative to the planes of the table top. When the table top is then placed on a flat, level surface the legs will then appear as illustrated in FIG. 1*a*.

With reference to FIGS. 2 and 6-8, braces 28 are somewhat V in shape having a pair of limbs 28*a,b* which intersect at an apex 28*c*. The limbs are pivotally mounted to the rear legs of the leg assemblies and when the leg assemblies are unfolded, the apices of the braces come into contact with separate brace locks, generally 60. The brace locks are attached to the under or lower surface 10*b* of the table top.

Each brace lock is provided with a wall 62 which extends outwardly from the under surface of the table top. A slot 64 is formed in the wall for removable receipt of the apex of the brace. The apex is removably locked in the slot as illustrated in FIG. 7 by means of a keeper 66. The keeper is resiliently biased into contact with the apex and functions to limit movement of the brace relative to the table top in order to stabilized the table when it is unfolded. The apex of the brace can be removed from the brace lock simply by applying pressure on the keeper opposed to its bias to widen the slot in which the brace is received.

With reference to FIG. 9, the leg assembly, generally 70, has forward and rear legs 72, 74 respectively which are interconnected at the top by an upper web 76 and at the bottom by a lower web 78. Since both the shorter and longer leg assemblies 12, 14 in the previous Figures have the same components as leg assembly 70, albeit of different dimensions, leg assembly 70 represents both the shorter and the longer leg assemblies.

With reference to FIGS. 11 and 12, the leg assembly 70 has oppositely facing inside and outside walls 80, 82, respectively. The outside wall 82 faces outward of the foldable table when each of the two leg assemblies are assembled in the operative position as illustrated in FIG. 1*d* while the inside wall 80 of each leg assembly faces the other leg assembly when the leg assemblies are in the operative position.

As illustrated in FIGS. 10 and 11, a brace, generally 84, has upper and lower limbs 84*a,b,* respectively which meet at an apex 84*c*. The lower limb 84*b* is mounted for pivoting to the rear leg 74 while the upper limb 84*a* is mounted for pivoting to the upper web 76.

In the position illustrated in FIGS. 9-11 the brace and leg assemblies are in an inoperative position and the table is folded for storage The brace is within a space identified by the letter "A" in FIG. 11. The boundaries of the space are as follows: the side boundaries are defined by the facing side edges 86 of the front and back legs 72, 74. The top and bottom boundaries of space "A" are defined by the facing edges 87 of the upper and lower webs 76, 78 while the inner and outer boundaries are defined by imaginary planes 90, 92 illustrated in FIG. 12 which also define the inside and outside walls 80, 82, respectively, of the leg assembly.

The brace is wholly within space "A"; no portion of it lies outside the space. Accordingly when the legs are folded for storage, the braces do not add to the thickness of the table. This feature is explained below and is illustrated in FIGS. 13*a, b* and 14.

With reference first to FIG. 13*a,* the shorter leg assembly lies on top of ate longer leg assembly (arrow "S" points to the front leg 72S of the shorter kg assembly while arrow "L" points to the front leg 72L of the longer kg assembly). Accordingly, the front leg 72S and the lower web 78S of the shorter leg assembly he on top of the front leg 72L and brace 84L of the longer leg assembly.

Brace 84L is pivotally attached to the upper web 76L of the longer leg assembly while brace 84S is pivotally attached to the upper web 76S of the shorter leg assembly.

With reference to FIGS. 13*b* and 14, the leg assemblies are folded into an inoperative position and its thickness is made up of the thickness of the side edge of the table top, indicated "TT", the thickness of the longer leg assembly. indicated "TL" and the thickness of the shorter leg assembly TS.

There is a skirt 120 which extends downward from the perimeter of the table top. The leg assemblies are surrounded by the skirt when they are inoperative, In most of the drawings, the shirt is eliminated since its only function is aesthetic. It forms no part of the subject invention. In FIG. 14, the side edge of the table top is indicated 122. Above the table top is the side edge of the upper web 76L of the longer leg assembly and above that is the side edge of the lower web 78S of the shorter leg assembly. The edges mentioned are visible but the braces to which they are attached are not, they being behind and hidden by the side edges. Thus brace 84L is hidden by the upper web of the longer leg assembly while brace 84S is hidden by the lower web of the shorter assembly.

As previously explained, each brace is within the space which is surrounded by the legs and webs of the assemblies to which they are attached. No portion of either brace protrudes above or below the space. Accordingly the thickness of the table of the subject invention, when folded in an inoperative position as illustrated in FIG. 14 is composed of the thickness of the edge of the table top, and the thicknesses of the side edges of both the longer and shorter leg assemblies. The braces do not contribute to the thickness of the folded table. Thus, and with reference to FIGS. 5 and 14, when the leg assemblies are folded into an inoperative position, the thickness of the table, measured normal to the upper surface of the table top, and composed of thicknesses, TT, TL and TS is made up entirely of these thicknesses.

The subject table accordingly occupies a space which has an upper limit defined by the upper surface of the table top and a lower limit defined by the outside edge of the shorter leg assembly. The braces do not add to the thickness of the table when folded for storage.

It will be understood, of course, that modification can he made in the embodiments of the folding table of the invention without departing from the scope and purview of the invention as defined in the appended claims.

I claim:

1. A foldable table comprising: a planar table top having oppositely facing upper and lower surfaces; longer and shorter leg assemblies each including a pair of spaced apart legs having floor contacting surfaces and each being pivotal with respect to said table top from an operative position in which said kg assemblies support said table top in a horizontal position for use, to an inoperative position in which said table top and said leg assemblies are folded together for storage, said longer and shorter leg assemblies being pivotal about first and second axes, respectively, said first axis being spaced apart from said upper surface of said table top a distance less than the distance between said second axis and said upper surface, said distances being measured perpendicular to said upper surface, said leg assemblies each having oppositely facing inside and outside edges, said outside edges facing outward of said foldable table while said inside edges face one another when said kg assemblies are in said operative position, said leg assemblies when folded together in said inoperative position being positioned such that said inside edge of said longer leg assembly is in contact with said lower surface of said table top along its entire length while said outside edge of said longer leg assembly is in contact with said inside edge of said shorter leg assembly along its entire length such that said longer leg assembly, when said longer and shorter leg assemblies are in said inoperative position, lying adjacent to and between said lower surface of said table top and said shorter leg assembly along its entire length; and a pair of braces each pivotal relative to a separate said leg assembly and each removably attached to said table top when each said leg assembly is in said operative position, each said brace being disposed within an area defined by said pair of legs in each separate said leg assembly when said longer and shorter leg assemblies are in said inoperative position, said foldable table when said leg assemblies are in said inoperative position occupies a space which has an upper limit defined by said upper surface of said table top and a lower limit defined by said outside edge of said shorter leg assembly, said braces being disposed entirely with said space.

2. A foldable table comprising: a planar table top having oppositely facing upper and lower surfaces; longer and shorter leg assemblies each including a pair of spaced apart legs having floor contacting surfaces and each being pivotal with respect to said table top from an operative position in which said leg assemblies support said table top in a horizontal position for use, to an inoperative position in which said table top and said leg assemblies are folded together for storage, said longer and shorter leg assemblies being pivotal about first and second axes, respectively, said first axis being spaced apart from said upper surface of said table top a distance less than the distance between said second axis and said upper surface, said distances being measured perpendicular to said upper surface, said leg assemblies having oppositely facing inside and outside edges and side edges, said outside edges facing outward of said foldable table while said inside edges facing one another when said leg assemblies are operative, a side edge being formed on each said spaced apart leg in each said leg assembly, said side edges in each said leg assembly facing one another, said leg assemblies when folded together in said inoperative position being positioned such that said inside edge of said longer leg assembly is in contact with said lower surface of said table top along its entire length while said outside edge of said longer leg assembly is in contact with said inside edge of said shorter leg assembly along its entire length such that said longer leg assembly, when said longer and shorter leg assemblies are in said inoperative position, lying adjacent to and between said lower surface of said table top and said shorter leg assembly along its entire length; and a pair of braces each pivotal relative to a separate said leg assembly, each said brace when said leg assemblies are in said inoperative position being entirely confined within a space in each separate said leg assembly, said space having side boundaries and front and back boundaries, said side boundaries being defined by said facing side edges of said each separate leg assembly while said front and back boundaries being defined by a pair of spaced apart imaginary planes in one of which lie said outside edge of said each separate leg assembly and in the other said plane lie said inside edge of said each separate leg assembly.

* * * * *